United States Patent [19]

Armington

[11] Patent Number: 4,650,456

[45] Date of Patent: Mar. 17, 1987

[54] MECHANISM FOR PRODUCING PAD-LIKE CUSHIONING DUNNAGE PRODUCT FROM SHEET MATERIAL WITH SEPARATE STOCK ROLL CART

[75] Inventor: Steven E. Armington, Mentor, Ohio

[73] Assignee: Ranpak Corp., Willoughby, Ohio

[21] Appl. No.: 793,081

[22] Filed: Oct. 30, 1985

[51] Int. Cl.[4] ..... B31F 1/10; B65H 19/30

[52] U.S. Cl. ..... 493/464; 493/967; 242/58.6; 242/86.52; 403/388; 403/387

[58] Field of Search ..... 493/357, 464, 477, 967; 242/55.2, 58.6, 79, 86.52; 403/388, 387, 393, 379

[56] References Cited

U.S. PATENT DOCUMENTS

| | | | |
|---|---|---|---|
| 1,509,835 | 9/1924 | Grossenbach | 403/387 |
| 2,810,597 | 10/1957 | Poss | 403/388 |
| 3,325,120 | 6/1967 | Brinkman | 242/86.52 |
| 3,415,554 | 12/1968 | Papayoti | 403/388 |
| 3,650,419 | 3/1972 | Upshur et al. | 242/58.6 |
| 3,789,757 | 2/1974 | Motter et al. | 242/58.6 |
| 3,880,372 | 4/1975 | Witte | 242/58.6 |
| 4,026,198 | 5/1977 | Ottaviano | 493/357 |
| 4,305,601 | 12/1981 | Berge | 403/388 |
| 4,557,716 | 12/1985 | Ottaviano | 493/464 |

*Primary Examiner*—Lowell A. Larson
*Assistant Examiner*—William E. Terrell
*Attorney, Agent, or Firm*—Baldwin, Egan & Fetzer

[57] ABSTRACT

A converter mechanism for producing low density, pad-like resilient cushioning dunnage product from sheet-like stock material, such as for instance paper, with a separate mobile cart for rotatably mounting a roll of sheet-like stock material thereon in position for feeding the stock material into the converter mechanism. The cart comprises a framework open at its forward end and including spaced upright members, and adapted to receive therebetween in generally snug relation a laterally projecting portion of the converter mechanism for coupling the cart to the converter mechanism especially in a direction transverse of the converter mechanism and cart, and providing for expeditiously positioning the cart and the associated stock roll in proper position adjacent the converter mechanism. The cart comprises a base frame and forward and rearward uprights having cross pieces connecting the respective pair of forward and rearward uprights, and with the forward uprights being of a shorter upwardly projecting height as compared to the height of the rearward uprights.

8 Claims, 4 Drawing Figures

MECHANISM FOR PRODUCING PAD-LIKE CUSHIONING DUNNAGE PRODUCT FROM SHEET MATERIAL WITH SEPARATE STOCK ROLL CART

This invention relates in general to a converter mechanism for producing packing material or cushioning dunnage as it is known in the art from sheet-like stock material, and more particularly to a dunnage producing converter mechanism for the production of a continuous resilient pad-like dunnage product from sheet-like stock material disposed in roll form, with the roll of stock material being rotatably mounted on a separate mobile cart useable in conjunction with the converter mechanism, and with the cart comprising an open framework at its forward end receiving in generally embracing relation a laterally projecting structural portion of the converter mechanism therein when the cart is positioned adjacent the converter mechanism, for detachably coupling the cart and the converter mechanism together against relative movement, and especially movement in a direction transverse thereof, during use of the cart for supplying the stock material of the roll to the converter mechanism.

The invention also provides a novel arrangement of mobile stock roll supporting cart which is expeditiously coupleable with the converter mechanism, and which provides an open ended framework structure for the coupling operation, and which open ended framework structure also expedites the mounting of a stock roll on the stock roll cart.

BACKGROUND OF THE INVENTION

In U.S. Pat. 4,026,198 dated May 31, 1977 in the name of Gary W. Ottaviano, and entitled Cushioning Dunnage Mechanism Transfer Cart Therefor and Method, there is disclosed a cushioning dunnage producing converter mechanism which produces pad-like cushioning dunnage of the general type and in the general manner as that produced by the converter mechanism of the present invention.

Also, in copending U.S. patent application Ser. No. 510,671 dated July 5, 1983 now U.S Pat. No. 4,557,716 in the name of Gary W. Ottaviano, and entitled Mechanism For Producing Pad-Like Cushioning Dunnage From Sheet Material, there is disclosed a separate, mobile, stock roll cart for mounting a stock roll in predetermined relationship with respect to a converter mechanism of the general type of aforementioned U.S. Pat. No. 4,026,198, and having coupling means on the cart and on the converter mechanism for detachably coupling the cart to the converter mechanism in the production of a pad-like cushioning dunnage product of the general type produced by the converter mechanism of the present invention.

The converter mechanism utilized in the present combination may be of the same general type as that disclosed in the aforementioned patent and aforementioned pending patent application, but as disclosed herein is of a revised structural arrangement and includes laterally projecting bracket structure thereon mounting a separating section of the converter mechanism, and wherein the stock roll supporting cart is expeditiously coupleable with such revised converter mechanism structure, for positioning of the stock roll of sheet-like stock material in proper position with respect to the converter mechanism, whereby the sheet-like stock material can be expeditiously pulled from the stock roll into the converter mechanism in the production of the cushioning dunnage product.

The mobile stock roll cart is of a structural arrangement wherein the stock roll is able to be expeditiously mounted or positioned on the cart for its use in conjunction with the converter mechanism, and wherein the cart is readily coupleable to and uncoupleable from the converter mechanism.

SUMMARY OF THE INVENTION

The present invention provides a dunnage producing converter mechanism in combination with a separate mobile stock roll mounting cart wherein the cart can be expeditiously coupled to the converter mechanism for positioning of the stock roll in proper location with respect to the converter mechanism for furnishing stock material to the converter mechanism for forming into a resilient padlike cushioning product, and wherein the cart can be expeditiously uncoupled from the converter mechanism. The cart is adapted to embrace laterally projecting structure on the converter mechanism for expeditious coupling and uncoupling of the mobile cart to and from the converter mechanism, and with the cart having a frontal open ended framework structure which provides for the coupling of the cart to the converter mechanism, and which materially expedites the loading of a stock roll onto the cart.

Accordingly, an object of the invention is to provide a novel combined arrangement of dunnage producing converter mechanism and separate stock roll cart, with the cart being expeditiously coupleable to and uncoupleable from, the converter mechanism.

Another object of the invention is to provide in the above combination a stock roll cart which is of open ended construction at its forward end, for embracing a laterally projecting structure of the converter mechanism, for providing for expeditious coupling of the stock roll cart to the converter mechanism, and wherein such open ended construction also enables a more expeditious loading of a stock roll onto the stock roll cart preparatory to positioning of the cart in coacting relationship with respect to the converter mechanism.

A still further object of the invention is to provide in a combination of the aforediscussed type, a stock roll cart which includes a base frame and uprights projecting upwardly from the forward and rearward ends of the base frame, with the forward uprights being of a lesser height as compared to the rearward uprights, with such forward uprights being adapted to embrace the aforementioned laterally projecting structure of the converter mechanism, for detachably coupling the stock roll cart to the converter mechanism.

A still further object of the invention is to provide a mobile stock roll support cart which is adapted for utilization with a compact dunnage producing converter mechanism to produce resilient pad-like cushioning dunnage product, and wherein the stock roll cart embodies means which is adapted for coupling the cart to the converter mechanism, and which facilitates the loading of a stock roll onto the cart preparatory to positioning of the cart and associated stock roll in operative coupled relationship to the converter mechanism.

Other objects and advantages of the invention will be apparent from the following description taken in conjunction with the accompanying drawings wherein:

DESCRIPTION OF PREFERRED EMBODIMENT

Figure 1:
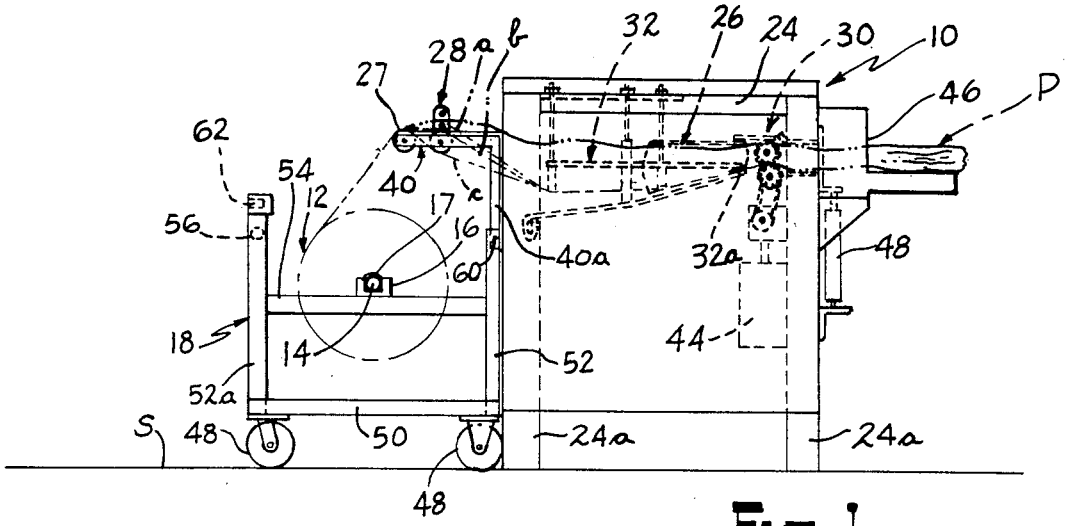
FIG. 1 is a generally diagrammatic, side elevational view of a dunnage producing converter mechanism and a separate mobile stock roll support cart disposed in coupled operative position for furnishing sheet stock material to the dunnage producing converter mechanism, in the production of resilient pad-like cushioning dunnage product, in accordance with the invention.

Referring now again to the drawings, there is illustrated a dunnage producing converter machine or mechanism 10 which is adapted to utilize a multi-ply stock roll 12 of sheet-like material, such as for instance, webs of superimposed kraft paper, in connection therewith, and as generally illustrated for instance in the aforementioned copending U.S. patent application Ser. No. 510,671.

The roll 12 of stock material is adapted to be rotatably mounted on a supporting rod 14 extending through the roll of stock material, which in turn is adapted to be mounted on its ends onto spaced brackets 16 on the separate mobile cart 18. Stock roll 12 in the embodiment illustrated is comprised of three superimposed webs or sheets of material, such as for instance kraft paper, which is preferred, wound about a cylindrical hollow core 17, but could be comprised of a lesser or greater number of webs of sheet stock, and which are preferably of generally equal width.

One end of the aforementioned rod 14 extending through the stock roll is adapted to have an opening therethrough receiving a transverse pin (not shown) projecting laterally from the rod for preventing or limiting rotation of the rod 14 upon rotation of the roll about the rod. In other words, the roll 12 of stock material and associated core 17 is adapted to frictionally rotate relative to supporting rod 14 during pulling of the sheet stock material into the dunnage producing converter mechanism 10, and in the general manner described in conjunction with the arrangement shown in aforementioned pending U.S patent application Ser. No. 510,671.

Converter mechanism 10 comprises, in the embodiment illustrated, a main support frame 24 including leg portions **24*a* supporting the machine with respect to a supporting surface S. Frame 24 supports a longitudinally converging chute or funnel member 26** which forms a guide and support for the webs a, b and c of the stock material drawn off from the stock roll as they pass through the converter mechanism.

From the stock roll, the webs a, b and c thereof are adapted to move about common entry point member 27 extending transverse of the converter mechanism, through separating mechanism 28, and then through the aforementioned funnel member 26, after which they pass to the connecting section 30 of the dunnage producing converter mechanism, and in the general manner described in the aforementioned pending patent application, which is incorporated herein by reference.

A pusher or forming frame 32 which may be of the general type of copending U.S. patent application Ser. No. 609,001 filed May 10, 1984 in the name of Gary W. Ottaviano, and entitled Mechanism and Method For Producing Cushioning Dunnage, extends into the funnel member 26, with such forming frame being of generally triangular shape in plan, with the forward end nose portion **32*a* thereof being positioned generally adjacent the exit end of the funnel member, and with the rearward portion of the body of the forming frame extending rearwardly of the entrance end of the funnel member. As can be seen in FIG. 1 the funnel member 26 has a widened entrance end and converges longitudinally in the direction of the connecting section 30, which connects together the lateral resilient pillow-like portions of the produced dunnage product P. The forming frame and the funnel member in plan are disposed generally in-line with one another and with the connecting section 30. The forming frame 32** is adapted to slidingly engage with ahd press against the sheet-like stock material as it travels from the separating mechanism and through the funnel means to the connecting means, and urges the stock material into the lateral pillow-like portions of the produced pad-like cushioning product.

Figure 4:
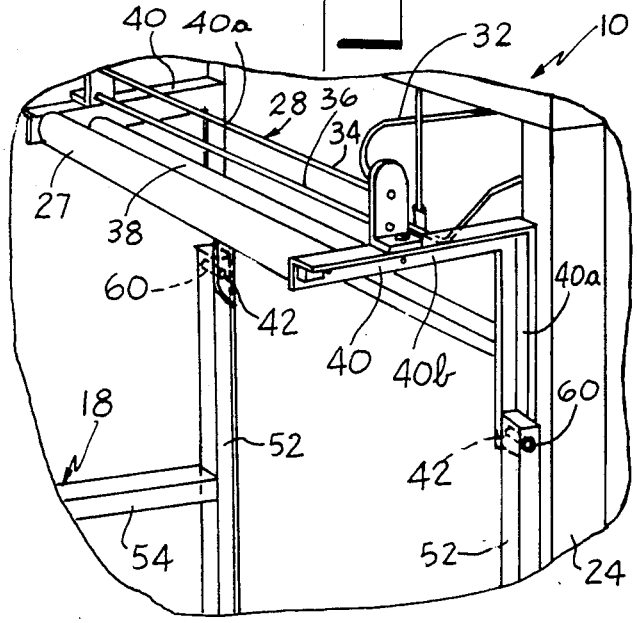
FIG. 4 is a fragmentary, enlarged, perspective illustration of the coupled arrangement of FIGS. 1 and 3, illustrating in greater detail the embracing coaction of the forward uprights of the cart framework structure with the laterally projecting bracket structure of the converter mechanism which supports the common stock material entry roller, and the sheet separating section of the converter mechanism.

The aforementioned separating means 28 is adapted to receive the sheet-like stock material from the stock roll and via the common entry member 27, and to separate the multi-plies of the stock material into individual plies or webs, prior to their passing beneath the forming frame 32 and into the funnel member 26, thus aiding in maintaining the resiliency of the produced dunnage product P. The separating means comprises a plurality, and in the embodiment illustrated three, of vertically spaced generally horizontally oriented bar-like elements 34, 36 and 38 (FIG. 4) about which is adapted to pass a respective web of the stock material from the rotatable stock roll prior to passage thereof past the forming frame and into the funnel member.

The supporting framework in the embodiment of converter illustrated for the separating mechanism 28 comprises laterally spaced angle iron brackets 40 of generally inverted L-shape in side elevation (FIG. 4) with each bracket being secured at its vertical arm **40*a* as by welding to the converter frame 24 and with the upper horizontal arm 40*b* of the bracket supporting the separating means thereon. In this embodiment of separating means, the lower bar member 38 is a roller, rotatable with respect to support brackets 40. Adjacent the lower end of each bracket 40, the rearwardly projecting web of lower arm 40*a* is provided with an opening 42** therethrough for a purpose to be hereinafter described.

Disposed outwardly and upstream from the separating mechanism 28 and also supported on the upper arm **40*b* is the aforementioned common entry member 27 for the stock material, and which in the embodiment illustrated, is a rotatable roller having a cylindrical exterior surface, with the ends of the roller being rotatably mounted directly on the spaced upper arms 40*b* of the brackets 40. Roller member 27** provides a nonvarying point of entry of the plies of sheet-like stock material from the stock roll as they are pulled into the dunnage producing converter mechanism, toward the separating means, irrespective of the diameter of the stock roll. Thus, in the event of utilizing a larger or a smaller diameter stock roll, or as the stock roll is used up during the operation of the converter mechanism, the point of entry of the stock material toward the separating means remains constant, thereby facilitating the more uniform production of dunnage pad.

The connecting section 30 of the converter mechanism illustrated comprises generally loosely meshed generally vertically oriented gear-like elements which are rotatably mounted as by means of a respective shaft for rotation relative to the funnel member 26. The connecting gear-like means are operatively coupled to a prime mover, such as, for instance, an electric motor 44 mounted on the machine frame. Actuation of the motor 44 will cause rotation of the meshed gear-like means, thus coining or connecting the stock material by rotation of the gears as the rolled edge stock material passes therebetween, and also operating to pull the crumpled stock material through the mechanism from the stock roll, after which the pad-like cushioning product is emitted from the discharge end 46 of the machine by the rotatable driven gear-like elements of connecting section 30. The produced dunnage product P can be cut into selected lengths as by means of known cutter mechanism 48 mounted on the rearward end of the converter machine. Reference may be had to the aforementioned prior art U.S. Pat. No. 4,026,198 which is incorporated herein by reference, for a more detailed discussion of a structural arrangement of cutter for a converter mechanism producing pad-like dunnage product P.

Figure 2:
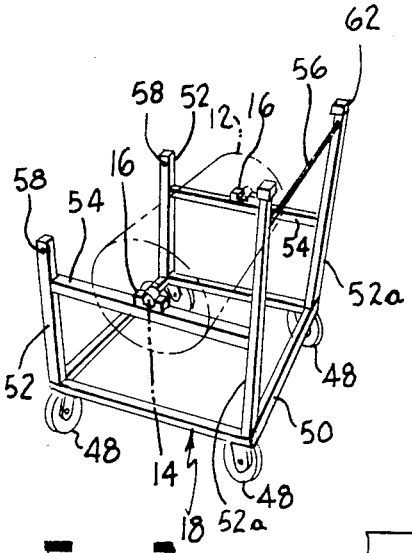
FIG. 2 is a generally perspective view of the stock roll support cart per se taken from the rear left corner thereof, and illustrating the forward end open construction thereof; a stock roll is illustrated in phantom lines, mounted on the cart.
Figure 3:
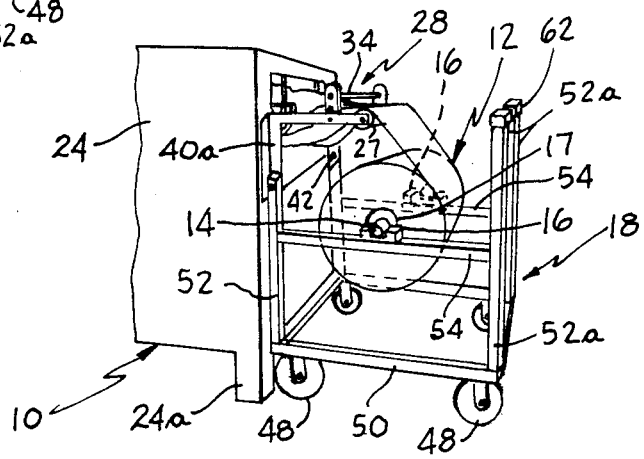
FIG. 3 is a fragmentary, generally perspective view of the stock roll cart coupled to the dunnage producing converter mechanism.

The aforementioned stock roll supporting cart 18 preferably is of fabricated construction, and as best illustrated in FIGS. 2 and 3 preferably embodies anti-friction means such as the wheels 48 for facilitating movement of the cart over the floor surface S, and into coacting connected relationship with the dunnage converter mechanism 10. The rear wheels on the cart are preferably pivotable with respect to the cart so as to facilitate maneuvering of the cart into connected relationship with the dunnage producing mechanism 10.

The cart comprises a base frame 50 and upright members 52, 52*a* at respectively the forward and rearward ends of the base frame of the cart. The forward upright members 52 are of a lesser height as compared to the rear upright members as best seen in FIGS. 1, 2 and 3, with the forward and the rear uprights being connected by means of cross bars 54 as shown in FIGS. 2 and 3, with such cross bars mounting thereon the aforementioned stock roll support brackets 16 for rotatably mounting the supporting rod 14 of the stock roll on the cart.

The rear uprights 52*a* are preferably provided with a transversely extending bar member 56 connecting the rear uprights, which can be utilized as a handle useable by the machine operator, for readily moving the cart 18 into coacting coupled relationship with the converter mechanism, and for withdrawing the cart from the converter mechanism, when replacement of the stock roll thereon is desired or necessary.

When it is desired to move the cart into coacting relationship with the converter mechanism, the workman can grasp the handle 56 and push the cart generally linearly forwardly, whereby the forward uprights 52 embrace the lower portions of the rearwardly projecting webs on the vertical arms 40*a* of brackets 40 of the separating mechanism support structure, to thus couple the mobile cart to the converter mechanism and especially in a direction transversely thereof. This embracing of bracket structure 40 by the forward uprights 52 of the cart is preferably a generally snug coaction, so that withdrawal of the cart longitudinally from the converter mechanism is frictionally resisted. In this connection, the forward uprights 52 of the cart and the rearwardly projecting webs of arms 40*a* on the supporting bracket members 40 may have and preferably do have openings 58 therein which are adapted for alignment with the respective aforementioned opening 42 in the rearwardly projecting webs of arm sections 40*a* when the cart 18 is in coacting position with the converter mechanism 10 as shown in FIG. 1, for insertion therethrough of a removable pin 60 (FIG. 4) or the like, for detachably locking the cart to the converter mechanism. It will be seen that the open condition of the framework structure at the forward end of the cart, enables the cart to be expeditiously positioned adjacent the converter mechanism so as to provide the embracing coaction between the forward uprights 52 on the cart and the rearwardly projecting bracket structure 40*a* on the converter mechanism.

In the latter coupled condition of the cart 18 and converter mechanism 10 it will be seen that the forward uprights 52 embrace the bracket arms 40*a* above the level of the roll mounting means 16 on the cart, but below and downstream from the separating means 28, with the roll mounting means on the cart being disposed generally upstream from a transverse vertical plane passing through the lengthwise axis of the common stock entry point roller 27, and with the multi-ply sheet-like stock material being pulled from the rearward side of the stock roll, as shown for instance in FIG. 1.

After the stock roll on a cart has been exhausted, the cart can be readily pulled away from its coupled relationship with respect to the converter mechanism (after removal of pins 60) and a new roll can be installed onto the cart after which it can be moved back into coacting relationship with the converter mechanism. In this connection because the forward end of the framework structure of the cart is open as aforedescribed, it facilitates the placing of a new stock roll onto the cart since the roll can be moved through the front end of the cart and the ends of the supporting rod 16 dropped into the brackets 16 on the cross members 54 of the cart. It can be readily seen that in the prior art type of cart as shown in aforementioned U.S. patent application Ser. No. 510,671, the front of the cart is not open and therefore any new roll has to be lifted up an increased height to clear the framework of the cart before it can be set down onto the rod supporting brackets on the cross members. Thus the present cart facilitates the reloading of the cart with a new stock roll. Generally in such reloading when utilizing relatively large stock rolls, two workmen are required, one grasping each end of the rod 14 on the stock roll to move it onto the cart.

In the embodiment illustrated, the rear uprights 52*a* on the cart are provided with receptacle structure 62 which are adapted to receive therein a respective projection on a dunnage producing mechanism of the type illustrated in the aforementioned pending application Ser. No. 510,671, to provide for coupling of the cart 18 to such type of dunnage producing mechanism, for feeding of the stock material into the dunnage producing mechanism. Thus, this type of cart can be utilized either with the type of converter mechanism 10 illustrated in the present patent application, or with the type illustrated in the aforementioned copending U.S. patent application Ser. No. 510,671, and therefore may be referred to as a "universal type" stock roll cart. It will be apparent when utilizing receptacle structure 62, that the cart has to be reversed so that the rearward end thereof becomes the forward end when coacting with the type of converter mechanism of Ser. No. 510,671.

From the foregoing description and accompanying drawings, it will be seen that the invention provides a novel combination of a converter mechanism and separate mobile stock roll cart for supporting a relatively large stock roll, for feeding into the converter mechanism, and which includes an open ended framework on the forward end thereof for receiving in embracing relationship laterally projecting support structure on the converter mechanism, for coupling the cart to the converter mechanism especially in a direction transverse thereof, and wherein means are provided on the cart and on the aforementioned laterally projecting structure for detachably locking the cart to the converter mechanism.

The invention also provides a stock roll support cart which can be conveniently manipulated for moving into and from coaction with the dunnage producing converter mechanism, and wherein the stock roll can be more expeditiously replaced on the cart as it is used up in conjunction with the production of pad-like cushioning dunnage product, due to the open nature of the framework structure of the cart.

The terms and expressions which have been used are used as terms of description and not limitation, and there is no intention in the use of such terms and expressions of excluding any equivalents of any of the features shown or described, or portions thereof, and it is recognized that various modifications are possible within the scope of the invention claimed.

I claim:

1. In combination a mechanism for producing low density pad-like cushioning dunnage product from sheet-like stock material, such as for instance paper, and a separate mobile cart coacting with said mechansim for supporting a roll of stock material thereon, said cart comprising a framework structure having means thereon for rotatably mounting a multi-ply roll of superimposed sheet-like stock material, said cart further comprising longitudinally forward and longitudinally rearward ends with said framework structure of said cart on said forward end comprising spaced uprights open therebetween from the base of each of said uprights to the upper extremity thereof, said rearward end of said cart including a transversely extending bar-like means providing a handle for manually moving the cart by a workman over a surface and to and from coupled coaction with said mechanism, said mechanism comprising a frame, and means on said mechanism frame projecting longitudinally rearwardly thereof and received in the open space between said uprights on said forward end of said cart in generally embraced relation by said uprights, for detachably coupling said cart to said mechanism, said mechanism being adapted to receive said stock material from said roll and produce said pad-like cushioning dunnage product therefrom, said cart being separable from said mechanism by grasping said handle and pulling longitudinally rearwardly.

2. The combination in accordance with claim 1 including other coupling means on said rearward end of said cart for coupling said cart to a different coupling means of another dunnate producing mechanism whereby said cart can be used with either of the dunnage producing mechanisms in coupled relation thereto.

3. The combination in accordance with claim 2 wherein said framework structure includes a base frame having said forward uprights extending upwardly from said base frame adjacent the forward end thereof, said forward uprights receiving therebetween in generally snug relationship said longitudinally rearwardly projecting means on said mechanism frame, the rearward end of said base frame having laterally spaced uprights extending upwardly therefrom, each of said rearward uprights having a receptacle thereon facing longitudinally rearwardly and comprising said other coupling means, and adapted to receive therein a fixed generally linearly extending horizontal projection on said other dunnage producing mechanism when the rearward end of said cart is moved into adjacent connected condition with said other dunnage producing mechanism.

4. The combination in accordance with claim 1 including means on said uprights of said framework structure and on said longitudinally rearwardly projecting means coacting with one another and adapted to receive removable interlocking means therein for detachably interlocking said cart to said mechanism in a longitudinal direction.

5. The combination in accordance with claim 1 wherein said cart framework structure comprises a base frame with said uprights projecting generally vertically upwardly from the forward end of said base frame, and with other spaced uprights extending upwardly from the rearward end of said base frame, said uprights on the forward end of said cart extending upwardly a lesser distance from said base frame as compared to the uprights on said rearward end of said cart.

6. The combination in accordance with claim 1 wherein said mechanism frame includes stitching means thereon adapted to receive the sheet-like stock material therein and operable to connect the same into a pad-like cushioning dunnage product, separating means on said frame longitudinally rearwardly from said stitching means adapted for separating the sheets of stock material as the latter move from the roll on said cart toward said mechanism, and spaced bracket members supporting said separating means and comprising said laterally projecting means of said mechanism, said separating means comprising vertically spaced bar-like members extending between said bracket members, said uprights embracing said bracket members above the level of said roll mounting means but below said separating means and forwardly in a longitudinal direction from said separating means.

7. The combination in accordance with claim 6 including an elongated, transversely extending stock engaging means mounted on said bracket members longitudianlly rearwardly from said separating means and about which the sheet-like stock material in multi-ply form is adapted to pass prior to passing to said separating means, said roll mounting means on said cart being disposed longitudinally rearwardly from a transverse vertical plane passing through the lengthwise axis of said stock engaging means, with the multi-ply sheet-like stock material being adapted to be pulled from the rearward side of the stock roll for feeding to said stock engaging means.

8. In combination a mechanism for producing low density pad-like cushioning dunnage product from sheet-like stock material, such as for instance paper, and a separate mobile cart coacting with said mechanism for supporting a roll of stock material thereon, said cart comprising a framework structure having laterally spaced means thereon for rotatably mounting a multi-ply roll of superimposed sheet-like stock material, said cart further comprising longitudinally forward and longitudinally rearward ends with said framework structure of said cart on said forward end comprising spaced uprights open therebetween from the base of each of said forward uprights to the upper extremity thereof, said rearward end of said cart comprising spaced uprights and including a transversely extending bar-like means between the last mentioned uprights providing a handle for manually moving the cart by a workman over a surface and to and from coupled coaction with said mechanism, said forward uprights extending upwardly a lesser distance as compared to the upward extension of said last mentioned uprights, said mechanism comprising a frame, and means on said mechanism frame projecting longitudinally rearwardly thereof and received in the open space between said forward uprights in generally embraced relation by said forward uprights, for detachably coupling said cart to said mechanism, and including means on said forward uprights and on said longitudinally rearwardly projecting means coacting with one another and adapted to receive removable interlocking means for detachably interlocking said cart to said mechansim, said cart upon removal of said interlocking means being separable from said mechanism by grasping said handle and pulling longitudinally rearwardly, said mechansim frame including stitching means thereon adapted to receive the sheet-like stock material from said roll therein and operable to connect the same into pad-like cushioning dunnage product, separating means on said frame longitudinally rearwardly from said stitching means adapted for separating the sheets of stock material as the latter move from the roll on said cart toward said mechanism, spaced bracket members supporting said separating means and comprising said longitudinally rearwardly projecting means of said mechanism, said separating means comprising vertically spaced bar-like members extending generally horizontally between said bracket members, said forward uprights enbracing said bracket members above the level of said roll mounting means on said cart, but below said separating means on said mechanism and forwardly in a longitudinal direction from said separating means, and an elongated transversely extending stock engaging member mounted on said bracket members longitudinally rearwardly from said separating means and about which the sheet-like stock material in multi-ply form from the roll on said cart is adapted to pass prior to passing to said separating means, said stock engaging member being disposed above the level of said roll mounting means on said cart and above the level of the areas of embracing coaction between said forward uprights and said bracket members, said roll mounting means on said cart being disposed longitudinally rearwardly from a transverse vertical plane passing through the lengthwise axis of said stock engaging member with the multi-ply sheet-like stock material being adapted to be pulled from the rearward side of the stock roll rotatably disposed in bridging relation between said roll mounting means on said cart, for feeding to said stock engaging member.

* * * * *